US010078300B2

(12) United States Patent
Samei et al.

(10) Patent No.: US 10,078,300 B2
(45) Date of Patent: Sep. 18, 2018

(54) FIXING DEVICE AND IMAGE FORMING APPARATUS

(71) Applicants: Masahiro Samei, Kanagawa (JP); Toshio Ogiso, Tokyo (JP); Tamotsu Ikeda, Tokyo (JP); Shigeo Nanno, Kanagawa (JP)

(72) Inventors: Masahiro Samei, Kanagawa (JP); Toshio Ogiso, Tokyo (JP); Tamotsu Ikeda, Tokyo (JP); Shigeo Nanno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/727,792

(22) Filed: Oct. 9, 2017

(65) Prior Publication Data

US 2018/0107142 A1 Apr. 19, 2018

(30) Foreign Application Priority Data

Oct. 19, 2016 (JP) ..... 2016-205315

(51) Int. Cl.
*G03G 15/20* (2006.01)

(52) U.S. Cl.
CPC ..... *G03G 15/2078* (2013.01); *G03G 15/2053* (2013.01); *G03G 15/2089* (2013.01)

(58) Field of Classification Search
CPC ..... G03G 15/2078; G03G 15/2053; G03G 15/2089
USPC ..... 399/69
See application file for complete search history.

(56) References Cited

U.S. PATENT DOCUMENTS

| | | | |
|---|---|---|---|
| 2016/0313684 | A1 | 10/2016 | Ikeda |
| 2016/0378028 | A1 | 12/2016 | Fujiwara et al. |
| 2017/0003634 | A1 | 1/2017 | Samei et al. |
| 2017/0045850 | A1 | 2/2017 | Fujii et al. |

FOREIGN PATENT DOCUMENTS

| | | | |
|---|---|---|---|
| JP | 2001056617 A | * | 2/2001 |
| JP | 2006-227038 | | 8/2006 |
| JP | 2007-065294 | | 3/2007 |
| JP | 2008-026362 | | 2/2008 |
| JP | 2014-089478 | | 5/2014 |

* cited by examiner

*Primary Examiner* — Susan Lee
(74) *Attorney, Agent, or Firm* — Oblon, McClelland, Maier & Neustadt, L.L.P.

(57) ABSTRACT

A fixing device includes a fixing rotator including a primary portion and a secondary portion disposed outboard from the primary portion in an axial direction of the fixing rotator. A pressure rotator contacts the fixing rotator to form a fixing nip between the fixing rotator and the pressure rotator, through which a recording medium is conveyed. A primary heater heats the primary portion of the fixing rotator. A secondary heater heats the secondary portion of the fixing rotator. A primary temperature detector is isolated from the fixing rotator and detects a temperature of the primary portion of the fixing rotator. A secondary temperature detector contacts the fixing rotator and detects a temperature of the secondary portion of the fixing rotator. The primary temperature detector has a thermal time constant that is smaller than a thermal time constant of the secondary temperature detector.

14 Claims, 4 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2016-205315, filed on Oct. 19, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one embodiment, the fixing device includes a fixing rotator that includes a primary portion and a secondary portion disposed outboard from the primary portion in an axial direction of the fixing rotator. A pressure rotator contacts the fixing rotator to form a fixing nip between the fixing rotator and the pressure rotator, through which a recording medium is conveyed. A primary heater heats the primary portion of the fixing rotator. A secondary heater heats the secondary portion of the fixing rotator. A primary temperature detector is isolated from the fixing rotator and detects a temperature of the primary portion of the fixing rotator without contacting the fixing rotator. A secondary temperature detector contacts the fixing rotator and detects a temperature of the secondary portion of the fixing rotator by contacting the fixing rotator. The primary temperature detector has a thermal time constant that is smaller than a thermal time constant of the secondary temperature detector.

This specification further describes an improved image forming apparatus. In one embodiment, the image forming apparatus includes an image bearer to bear a toner image and a fixing device to fix the toner image on a recording medium. The fixing device includes a fixing rotator that includes a primary portion and a secondary portion disposed outboard from the primary portion in an axial direction of the fixing rotator. A pressure rotator contacts the fixing rotator to form a fixing nip between the fixing rotator and the pressure rotator, through which the recording medium is conveyed. A primary heater heats the primary portion of the fixing rotator. A secondary heater heats the secondary portion of the fixing rotator. A primary temperature detector is isolated from the fixing rotator and detects a temperature of the primary portion of the fixing rotator without contacting the fixing rotator. A secondary temperature detector contacts the fixing rotator and detects a temperature of the secondary portion of the fixing rotator by contacting the fixing rotator. The primary temperature detector has a thermal time constant that is smaller than a thermal time constant of the secondary temperature detector.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
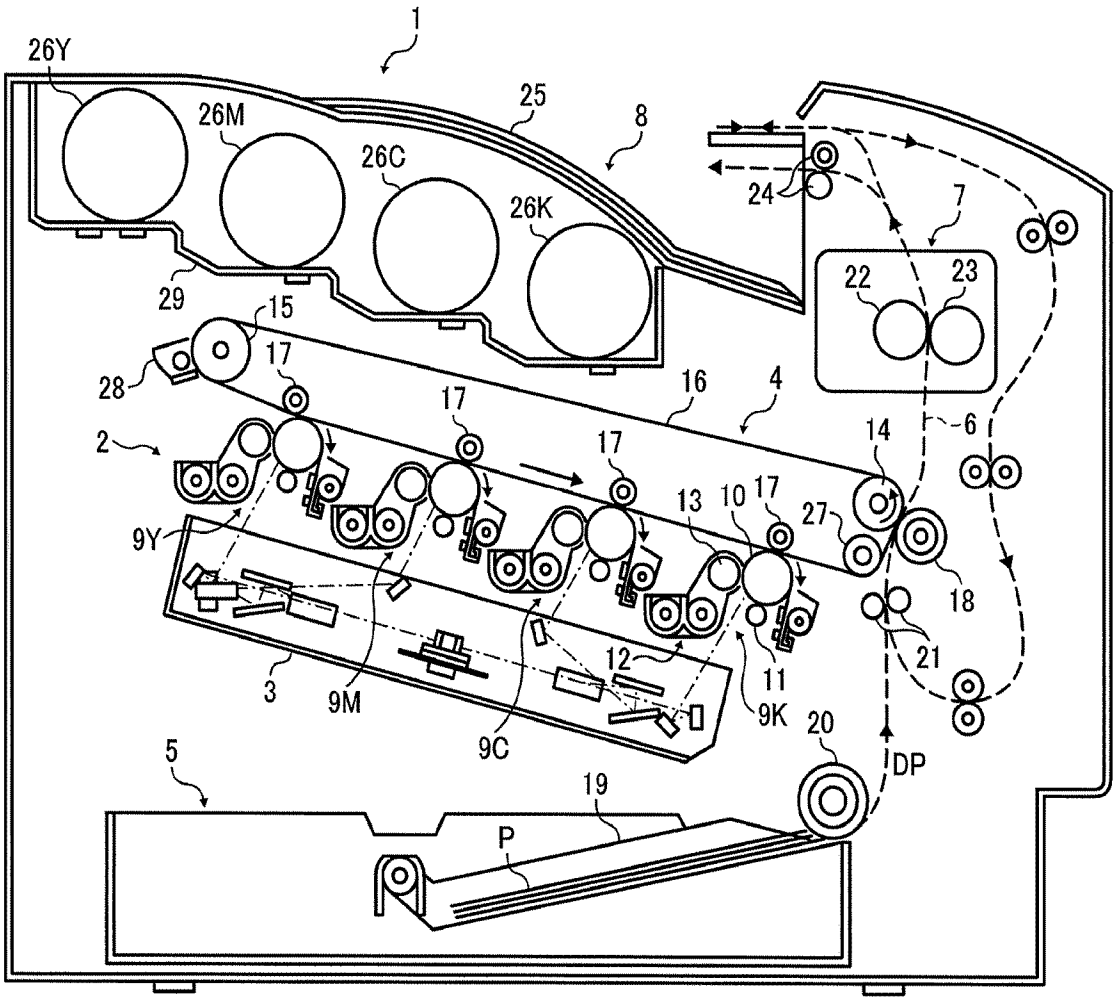
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this embodiment, the image forming apparatus 1 is a color printer that forms a color toner image on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

Identical reference numerals are assigned to identical components or equivalents and a description of those components is simplified or omitted.

As illustrated in FIG. 1, the image forming apparatus 1 includes an image forming device 2 disposed in a center portion of the image forming apparatus 1. The image forming device 2 includes four process units 9Y, 9M, 9C, and 9K removably installed in the image forming apparatus 1. Although the process units 9Y, 9M, 9C, and 9K contain developers (e.g., yellow, magenta, cyan, and black toners) in different colors, that is, yellow, magenta, cyan, and black corresponding to color separation components of a color image, respectively, the process units 9Y, 9M, 9C, and 9K have an identical structure.

For example, each of the process units 9Y, 9M, 9C, and 9K includes a photoconductive drum 10, a charging roller 11, and a developing device 12. The photoconductive drum 10 is a drum-shaped rotator or an image bearer that bears toner as developer of a toner image on an outer circumferential surface of the photoconductive drum 10. The charging roller 11 uniformly charges the outer circumferential surface of the photoconductive drum 10. The developing device 12 includes a developing roller 13 that supplies toner to the outer circumferential surface of the photoconductive drum 10. FIG. 1 illustrates reference numerals assigned to the photoconductive drum 10, the charging roller 11, and the developing device 12 of the process unit 9K that forms a black toner image. However, reference numerals for the process units 9Y, 9M, and 9C that form yellow, magenta, and cyan toner images, respectively, are omitted.

Below the process units 9Y, 9M, 9C, and 9K is an exposure device 3. The exposure device 3 emits a laser beam onto the photoconductive drum 10 according to image data.

A bottle housing 29 is disposed in an upper portion of the image forming apparatus 1. Toner bottles 26Y, 26M, 26C, and 26K are removably installed in the bottle housing 29 and replenished with fresh yellow, magenta, cyan, and black toners, respectively. Fresh yellow, magenta, cyan, and black toners are supplied from the toner bottles 26Y, 26M, 26C, and 26K to the developing devices 12 through toner supply tubes interposed between the toner bottles 26Y, 26M, 26C, and 26K and the developing devices 12, respectively.

Above the image forming device 2 is a transfer device 4. The transfer device 4 includes an endless intermediate transfer belt 16, primary transfer rollers 17, a secondary transfer roller 18, a secondary transfer backup roller 14, a cleaning backup roller 15, a tension roller 27, and a belt cleaner 28. The primary transfer rollers 17 are disposed opposite the photoconductive drums 10 of the process units 9Y, 9M, 9C, and 9K via the intermediate transfer belt 16.

The intermediate transfer belt 16 is an endless belt stretched taut across the secondary transfer backup roller 14, the cleaning backup roller 15, and the tension roller 27. As a driver drives and rotates the secondary transfer backup roller 14 counterclockwise in FIG. 1, the secondary transfer backup roller 14 rotates the intermediate transfer belt 16 counterclockwise in a rotation direction indicated by an arrow in FIG. 1 by friction therebetween.

The four primary transfer rollers 17 sandwich the intermediate transfer belt 16 together with the four photoconductive drums 10, forming four primary transfer nips between the intermediate transfer belt 16 and the photoconductive drums 10, respectively. The primary transfer rollers 17 are coupled to a power supply that applies at least one of a predetermined direct current (DC) voltage and a predetermined alternating current (AC) voltage thereto.

The secondary transfer roller 18 sandwiches the intermediate transfer belt 16 together with the secondary transfer backup roller 14, forming a secondary transfer nip between the secondary transfer roller 18 and the intermediate transfer belt 16. Similar to the primary transfer rollers 17, the secondary transfer roller 18 is coupled to the power supply that applies at least one of a predetermined direct current (DC) voltage and a predetermined alternating current (AC) voltage thereto.

The belt cleaner 28 includes a cleaning brush and a cleaning blade that contact an outer circumferential surface of the intermediate transfer belt 16. A waste toner drain tube extending from the belt cleaner 28 to an inlet of a waste toner container conveys waste toner collected from the intermediate transfer belt 16 by the belt cleaner 28 to the waste toner container.

In a lower portion of the image forming apparatus 1 is a sheet feeder 5. The sheet feeder 5 includes a paper tray 19 that loads a plurality of sheets P serving as recording media and a feed roller 20 that picks up and feeds a sheet P from the paper tray 19 toward the secondary transfer nip formed between the secondary transfer roller 18 and the intermediate transfer belt 16.

A conveyance passage 6 is a conveyance path through which the sheet P fed from the sheet feeder 5 is conveyed. The conveyance passage 6 extends from the sheet feeder 5 to a sheet ejector 8 described below. The conveyance passage 6 is provided with a registration roller pair 21 and a plurality of conveyance roller pairs.

A fixing device 7 (e.g., a fuser or a fusing unit) includes a fixing roller 22 and a pressure roller 23. The fixing roller 22 serves as a fixing rotator or a fixing member that is heated by a heater. The pressure roller 23 serves as a pressure rotator or a pressure member that is pressed against the fixing roller 22.

The sheet ejector 8 is disposed in a most downstream part of the conveyance passage 6 in a sheet conveyance direction DP. The sheet ejector 8 includes an ejection roller pair 24 and an ejection tray 25. The ejection roller pair 24 ejects the sheet P to an outside of the image forming apparatus 1. The ejection tray 25 stocks the sheet P ejected by the ejection roller pair 24.

Referring to FIG. 1, a description is provided of an image forming operation performed by the image forming apparatus 1 having the construction described above. As the image forming apparatus 1 receives a print job and starts an image forming operation, the exposure device 3 emits laser beams onto the outer circumferential surface of the photoconductive drums 10 of the process units 9Y, 9M, 9C, and 9K, respectively, according to image data, thus forming electrostatic latent images on the photoconductive drums 10. The image data used to expose the respective photoconductive drum 10 is monochrome image data produced by decomposing a desired full color image into yellow, magenta, cyan, and black image data. The drum-shaped developing rollers 13 of the developing devices 12 supply yellow, magenta, cyan, and black toners stored in the developing devices 12 to the electrostatic latent images formed on the photoconductive drums 10, visualizing the electrostatic latent images as developed visible images, that is, yellow, magenta, cyan, and black toner images, respectively.

The secondary transfer backup roller 14 of the transfer device 4 is driven and rotated counterclockwise in FIG. 1, rotating the intermediate transfer belt 16 in the rotation direction indicated by the arrow. The power supply applies a constant voltage or a constant current control voltage having a polarity opposite a polarity of the charged toner to the primary transfer rollers 17. Accordingly, a transfer electric field is produced at each of the primary transfer nips. The yellow, magenta, cyan, and black toner images are primarily transferred from the photoconductive drums 10 onto the intermediate transfer belt 16 successively at the primary transfer nips such that the yellow, magenta, cyan, and black toner images are superimposed on a same position on the intermediate transfer belt 16.

On the other hand, as the image forming operation starts, the feed roller 20 of the sheet feeder 5 disposed in the lower portion of the image forming apparatus 1 is driven and rotated to feed a sheet P from the paper tray 19 toward the registration roller pair 21 through the conveyance passage 6. The registration roller pair 21 conveys the sheet P sent to the conveyance passage 6 by the feed roller 20 to the secondary transfer nip formed between the secondary transfer roller 18 and the intermediate transfer belt 16 at a proper time. The secondary transfer roller 18 is applied with a transfer voltage having a polarity opposite a polarity of the charged yellow, magenta, cyan, and black toners of the yellow, magenta, cyan, and black toner images on the intermediate transfer belt 16, thus creating a transfer electric field at the secondary transfer nip. The transfer electric field created at the secondary transfer nip secondarily transfers the yellow, magenta, cyan, and black toner images formed on the intermediate transfer belt 16 onto the sheet P collectively, thus forming a full color toner image on the sheet P.

The sheet P bearing the full color toner image is conveyed to the fixing device 7 where the fixing roller 22 and the pressure roller 23 fix the full color toner image on the sheet P under heat and pressure. The sheet P bearing the full color toner image is separated from the fixing roller 22 and conveyed by the conveyance roller pair to the sheet ejector 8. The ejection roller pair 24 of the sheet ejector 8 ejects the sheet P onto the ejection tray 25.

The above describes the image forming operation of the image forming apparatus 1 to form the full color toner image on the sheet P. Alternatively, the image forming apparatus 1 may form a monochrome toner image by using any one of the four process units 9Y, 9M, 9C, and 9K or may form a bicolor toner image or a tricolor toner image by using two or three of the process units 9Y, 9M, 9C, and 9K.

A description is provided of a construction of the fixing device 7.

Figure 2:
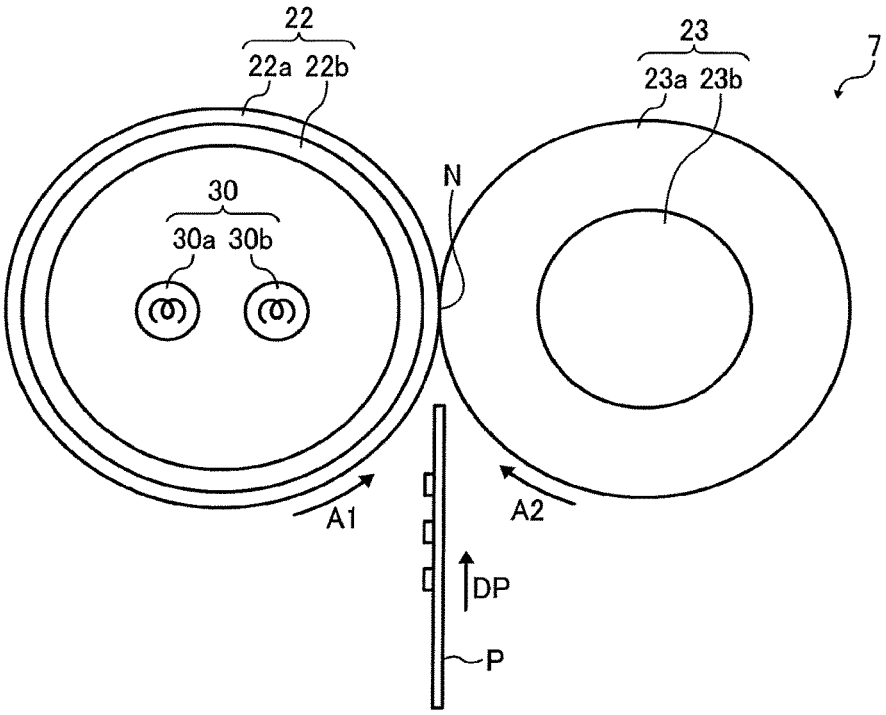
FIG. 2 is a schematic vertical cross-sectional view of a fixing device incorporated in the image forming apparatus depicted in FIG. 1.

FIG. 2 is a schematic vertical cross-sectional view of the fixing device 7. As illustrated in FIG. 2, the fixing device 7 includes the fixing roller 22 that is rotatable in a rotation direction A1 and the pressure roller 23 that is rotatable in a rotation direction A2. The pressure roller 23 contacts or presses against the fixing roller 22 to form a fixing nip N therebetween.

A detailed description is now given of a construction of the fixing roller 22.

The fixing roller 22 includes a surface layer 22*a* and a base layer 22*b*. The surface layer 22*a* includes an elastic layer being made of silicone rubber or the like and a release layer coating the elastic layer and being made of tetrafluoroethylene-perfluoroalkylvinylether copolymer (PFA). The base layer 22*b* is made of metal such as iron and aluminum. The base layer 22*b* has a thickness in a range of from 0.3 mm to 0.7 mm. The base layer 22*b* having a decreased thickness decreases a thermal capacity of the fixing roller 22 so that the fixing roller 22 is heated quickly, saving energy. Alternatively, the release layer may coat the base layer 22*b* directly.

A detailed description is now given of a construction of the pressure roller 23.

The pressure roller 23 includes an elastic layer 23*a* and a base layer 23*b*. The elastic layer 23*a* is made of silicone rubber or sponge. A release layer made of PFA or the like coats the elastic layer 23*a*. The base layer 23*b* is made of metal such as iron.

A halogen heater pair 30 serving as a heater is disposed inside the fixing roller 22 to heat the fixing roller 22. The halogen heater pair 30 includes two halogen heaters, that is, a center heater 30*a* and a lateral end heater 30*b*. The center heater 30*a* serves as a center portion heater that mainly heats a center portion of the fixing roller 22 in an axial direction thereof. The lateral end heater 30*b* serves as a lateral end portion heater that mainly heats a lateral end portion of the fixing roller 22 in the axial direction thereof. The axial direction of the fixing roller 22 is also called a width direction of the fixing roller 22. The center portion of the fixing roller 22 in the axial direction thereof is also called an inboard portion of the fixing roller 22 in the axial direction thereof. The lateral end portion of the fixing roller 22 in the axial direction thereof is also called an outboard portion of the fixing roller 22 in the axial direction thereof.

Figure 3:
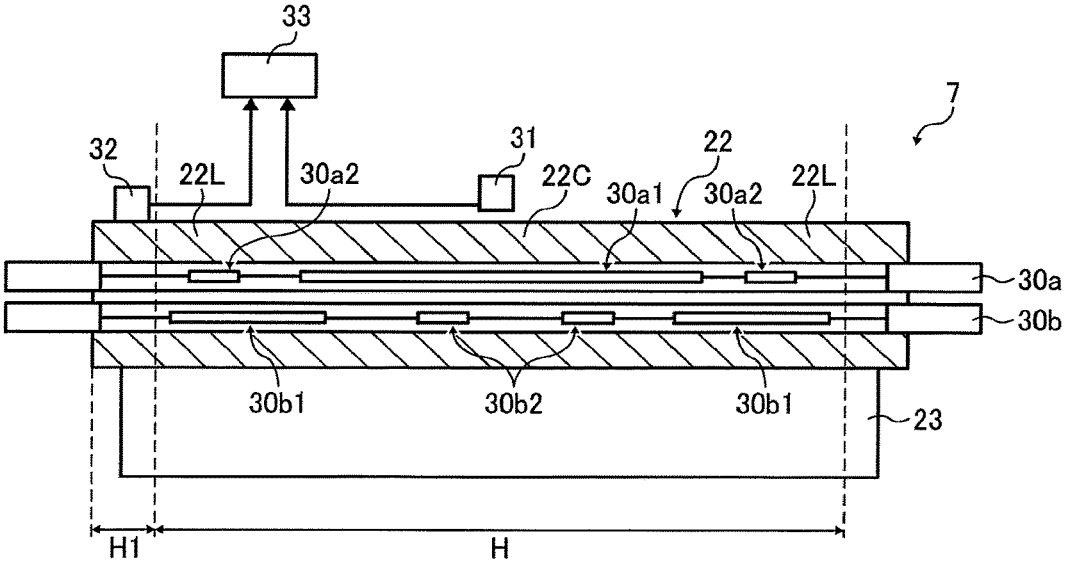
FIG. 3 is a horizontal cross-sectional view of the fixing device depicted in FIG. 2.

FIG. 3 is a horizontal cross-sectional view of the fixing device 7. As illustrated in FIG. 3, the center heater 30*a* includes a main heat generator 30*a*1 disposed in a center span of the center heater 30*a* in the axial direction of the fixing roller 22. A filament is coiled more densely in the main heat generator 30*a*1 than in other portion of the center heater 30*a*, that is, a sub heat generator 30*a*2. The lateral end heater 30*b* includes a main heat generator 30*b*1 disposed in each lateral end span of the lateral end heater 30*b* in the axial direction of the fixing roller 22.

Figure 4A:
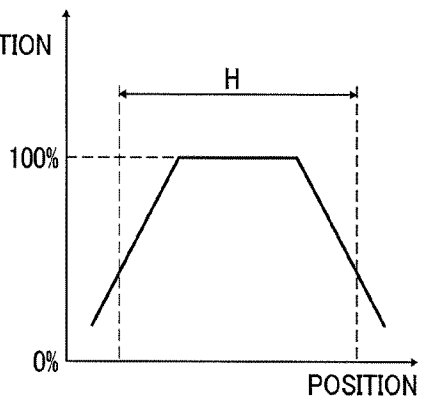
FIG. 4A is a graph illustrating a distribution of a heat generation amount of a center heater incorporated in the fixing device depicted in FIG. 3.

FIG. 4A is a graph illustrating a distribution of a heat generation amount of the center heater 30*a*. In FIG. 4A, a horizontal axis represents the position of the center heater 30*a* in the axial direction of the fixing roller 22. A vertical axis represents the heat generation amount of the center heater 30*a* defined as a heat generation rate.

Figure 4B:
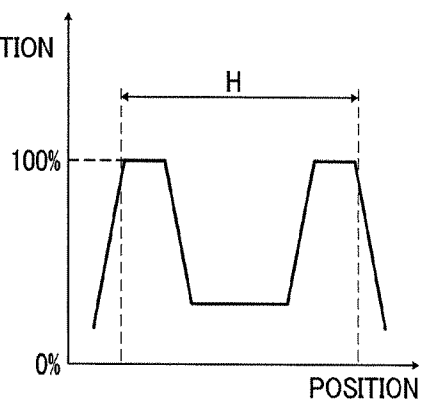
FIG. 4B is a graph illustrating a distribution of a heat generation amount of a lateral end heater incorporated in the fixing device depicted in FIG. 3.

FIG. 4B is a graph illustrating a distribution of a heat generation amount of the lateral end heater 30*b*. In FIG. 4B, a horizontal axis represents the axial direction of the fixing roller 22. A vertical axis represents the heat generation amount of the lateral end heater 30*b*. In each of the main heat generator 30*a*1 of the center heater 30*a* and the main heat generators 30*b*1 of the lateral end heater 30*b*, the number of coiling of the filament is greater than that in other portion (e.g., the sub heat generator 30*a*2 and a sub heat generator 30*b*2) of each of the center heater 30*a* and the lateral end heater 30*b*, so that the filament is coiled more densely than in each of the sub heat generators 30*a*2 and 30*b*2. Thus, the main heat generators 30*a*1 and 30*b*1 attain a peak heat generation amount.

Also in other portion of each of the center heater 30*a* and the lateral end heater 30*b*, which is other than the main heat generators 30*a*1 and 30*b*1, the filament is coiled with a predetermined number of coiling, thus attaining a predetermined heat generation amount. According to this embodiment, the number of coiling of the filament of the lateral end heater 30*b* is adjusted such that the sub heat generator 30*b*2 disposed in a center span of the lateral end heater 30*b* in the axial direction of the fixing roller 22 is supplied with power of about 20 percent of a rated power for the lateral end heater 30*b*.

Since the fixing device 7 incorporates two heaters (e.g., the center heater 30*a* and the lateral end heater 30*b*) defining different main heat generation spans (e.g., the main heat generators 30*a*1 and 30*b*1), respectively, the fixing device 7 switches between the different main heat generation spans according to the size of the sheet P conveyed through the fixing device 7. For example, when a small sheet P is conveyed through the fixing device 7, the center heater 30*a* generates heat. Conversely, when a large sheet P is conveyed through the fixing device 7, the center heater 30*a* and the lateral end heater 30*b* generate heat. The main heat generator 30*a*1 of the center heater 30*a* has a width equivalent to a width of the small sheet P in the axial direction of the fixing roller 22. For example, the width of the main heat generator 30*a*1 is equivalent to a width of an A5 size sheet in the axial direction of the fixing roller 22.

As illustrated in FIG. 3, the fixing device 7 includes two temperature detectors (e.g., temperature sensors) that detect the temperature of an outer circumferential surface of the fixing roller 22, that is, a center temperature detector 31 that detects the temperature of a center portion 22C of the fixing roller 22 in the axial direction thereof and a lateral end temperature detector 32 that detects the temperature of a lateral end portion 22L of the fixing roller 22 in the axial direction thereof.

Each of the center temperature detector 31 and the lateral end temperature detector 32 sends the detected temperature of the fixing roller 22 to a controller 33. For example, the controller 33 is a processor, that is, a central processing unit (CPU) provided with a random- access memory (RAM) and a read-only memory (ROM). The controller 33 controls the heat generation amount of the center heater 30*a* and the lateral end heater 30*b* based on the detected temperature of the fixing roller 22, thus adjusting the temperature of the outer circumferential surface of the fixing roller 22 to a predetermined temperature or lower. The controller 33 controls the temperature of the fixing roller 22 with a proportional-integral-derivative (PID) controller, for example.

The center temperature detector 31 is a non-contact temperature detector that is isolated from the fixing roller 22 and detects the temperature of the fixing roller 22 without contacting the fixing roller 22. According to this embodiment, a thermopile is used as one example of the center temperature detector 31.

The lateral end temperature detector 32 is a contact temperature detector that contacts the fixing roller 22 and detects the temperature of the fixing roller 22. The lateral end temperature detector 32 contacts the fixing roller 22 in a non-conveyance span H1 that is disposed outboard from a maximum conveyance span H in the axial direction of the fixing roller 22. The maximum conveyance span H is equivalent to a width of a maximum sheet P in the axial direction of the fixing roller 22. According to this embodiment, a thermistor is used as one example of the lateral end temperature detector 32.

Since the sheet P is conveyed over the center portion 22C of the fixing roller 22, toner, paper dust, and the like adhere to the outer circumferential surface of the fixing roller 22 in the center portion 22C thereof easily. Accordingly, if the center temperature detector 31 is a contact temperature detector that contacts the fixing roller 22, the toner, the paper dust, and the like may adhere to the center temperature detector 31, degrading responsiveness of the center temperature detector 31. For example, if the sheet P contains a substantial amount of calcium carbonate, the paper dust and the toner mixed with the paper dust may adhere to the fixing roller 22 easily and may not be removed from the fixing roller 22 readily. To address this circumstance, according to this embodiment, the center temperature detector 31 is a non-contact thermopile that is isolated from the fixing roller 22, preventing responsiveness of the center temperature detector 31 from degrading due to adhesion of the toner and the paper dust from the fixing roller 22 to the center temperature detector 31.

Conversely, the lateral end temperature detector 32 is disposed opposite the fixing roller 22 in the non-conveyance span H1. Accordingly, even if the lateral end temperature detector 32 is the contact temperature detector that contacts the fixing roller 22 as described above, the toner and the paper dust barely adhere from the fixing roller 22 to the lateral end temperature detector 32. The lateral end temperature detector 32, that is, the contact temperature detector that contacts the fixing roller 22, detects the temperature of the fixing roller 22 with improved precision. Additionally, even if the sheet P is jammed inside the fixing device 7 and wound around the fixing roller 22, the lateral end temperature detector 32 detects the temperature of the fixing roller 22. If the lateral end temperature detector 32 is the non-contact temperature detector, when the sheet P is jammed inside the fixing device 7, the sheet P may be sandwiched between the fixing roller 22 and the lateral end temperature detector 32. To address this circumstance, according to this embodiment, the contact temperature detector is used as the lateral end temperature detector 32, preventing the sheet P from being sandwiched between the fixing roller 22 and the lateral end temperature detector 32. The contact temperature detector is downsized at reduced manufacturing costs compared to the non-contact temperature detector, allowing the fixing device 7 to be downsized at reduced manufacturing costs.

As described above, according to this embodiment, the fixing device 7 employs the center temperature detector 31 that detects the temperature of the center portion 22C of the fixing roller 22 in the axial direction thereof and the lateral end temperature detector 32 that detects the temperature of the lateral end portion 22L of the fixing roller 22 in the axial direction thereof according to characteristics of detection positions where the center temperature detector 31 and the lateral end temperature detector 32 detect the temperature of the fixing roller 22, thus attaining the advantages described above. The fixing device 7 incorporates two temperature detectors of different types, that is, the contact temperature detector as the lateral end temperature detector 32 and the non-contact temperature detector as the center temperature detector 31. Thus, the fixing device 7 prevents the two temperature detectors from suffering from detection failure simultaneously. For example, according to this embodiment, even if the contact temperature detector (e.g., the lateral end temperature detector 32) suffers from detection failure as the contact temperature detector contacts the outer circumferential surface of the fixing roller 22, the non-contact temperature detector (e.g., the center temperature detector 31) is immune from detection failure.

A description is provided of a construction of a comparative fixing device.

The comparative fixing device includes a temperature detector that detects the temperature of a fixing rotator. A heat generation amount of a heater is adjusted based on the detected temperature of the fixing rotator so that the temperature of the fixing rotator is controlled within a predetermined temperature range. The temperature detector is a non-contact temperature detector that detects the temperature of an outer circumferential surface of the fixing rotator without contacting the fixing rotator or a contact temperature detector that detects the temperature of the outer circumferential surface of the fixing rotator by contacting the fixing rotator.

For example, the comparative fixing device may include a first temperature detector that detects the temperature of a center portion on an outer circumferential surface of a fixing roller in an axial direction thereof and a second temperature detector that detects the temperature of a lateral end portion on the outer circumferential surface of the fixing roller in the axial direction thereof. The first temperature detector is a non-contact thermistor that is isolated from the fixing roller. The second temperature detector is a contact thermistor that contacts the fixing roller. Since the first temperature detector detects the temperature of a conveyance span of the fixing roller where a recording medium is conveyed without contacting the fixing roller, the first temperature detector does not damage and stain the conveyance span of the fixing roller, preventing the fixing roller from degrading a toner image formed on the recording medium. Since the second temperature detector precisely detects the temperature of a non-conveyance span of the fixing roller where the recording medium is not conveyed by contacting the fixing roller, the second temperature detector enhances accuracy in detecting the temperature of the fixing roller without degrading the toner image formed on the recording medium. The comparative fixing device employs the first temperature detector and the second temperature detector that have different characteristics, respectively, according to the detection position where the first temperature detector and the second temperature detector detect the temperature of the fixing roller, thus attaining the advantages described above.

Since a predetermined interval is provided between the non-contact, first temperature detector and the fixing roller, the non-contact, first temperature detector may detect temperature increase of the fixing roller more slowly due to the predetermined interval compared to the contact, second temperature detector. The first temperature detector is susceptible to delay in detecting the temperature of the center portion of the fixing roller in the axial direction thereof. If the temperature of the center portion of the fixing roller in the axial direction thereof increases sharply, the first temperature detector may suffer from substantial delay in responding to temperature increase of the fixing roller, causing overshooting of the fixing roller and increasing of temperature ripple. For example, when the image forming apparatus is warmed up, a heater starts heating the fixing roller while a body of the image forming apparatus is cool. Accordingly, since the fixing roller dissipates heat from the lateral end portion of the fixing roller in the axial direction thereof, the center portion of the fixing roller in the axial direction thereof is susceptible to temperature increase. However, the first temperature detector may detect the temperature increase of the center portion of the fixing roller in the axial direction thereof slowly.

Delay in responding to the temperature increase of the center portion of the fixing roller in the axial direction thereof may cause a controller to suffer from delay in issuing an instruction to adjust the temperature of the fixing roller. As the temperature of the fixing roller increases excessively, the overheated fixing roller may degrade the toner image on the recording medium or may accelerate degradation of the fixing roller. If a fixing rotator having a reduced thermal capacity is used to save energy, the fixing rotator is susceptible to overheating. If the recording medium is jammed inside the comparative fixing device, rotation of the fixing rotator may be interrupted and a part of the fixing rotator may be heated intensively, resulting in overheating of the fixing rotator.

To address delay in response of the first temperature detector of the comparative fixing device, the fixing device 7 according to this embodiment has a configuration described below. The fixing device 7 incorporates the center temperature detector 31 that detects temperature increase of the center portion 22C of the fixing roller 22 in the axial direction thereof and the lateral end temperature detector 32 that detects temperature increase of the lateral end portion 22L of the fixing roller 22 in the axial direction thereof. Based on the temperatures of the fixing roller 22 detected by the center temperature detector 31 and the lateral end temperature detector 32, the controller 33 controls the center heater 30*a* and the lateral end heater 30*b* to interrupt or suppress heating of the fixing roller 22, preventing overheating of the fixing roller 22. However, if the center temperature detector 31 suffers from delay in response, that is, if it takes long for the center temperature detector 31 to detect temperature increase of the fixing roller 22 after the fixing roller 22 suffers from the temperature increase, the fixing roller 22 may overheat, increasing overshooting and temperature ripple of the fixing roller 22.

The fixing device 7 may employ the fixing roller 22 that has a reduced thermal capacity to save energy. According to this embodiment, the fixing device 7 employs the fixing roller 22 that has a reduced thermal capacity and includes the base layer 22*b* having a thickness in a range of from 0.3 mm to 0.7 mm. If the center heater 30*a* and the lateral end heater 30*b* heat the fixing roller 22 with a maximum output, the temperature of the fixing roller 22 increases at a speed of 20 degrees centigrade per second or higher.

As the halogen heater pair 30 heats the fixing roller 22 having the reduced thermal capacity, the temperature of the fixing roller 22 increases quickly. Hence, as the center temperature detector 31 suffers from delay in detecting the temperature of the fixing roller 22 as described above, the fixing roller 22 is susceptible to overheating. As the temperature of the fixing roller 22 increases excessively, the overheated fixing roller 22 may degrade the toner image on the sheet P or may accelerate degradation of the fixing roller 22. Additionally, the overheated fixing roller 22 may increase temperature ripple while the sheet P is conveyed over the fixing roller 22, resulting in fixing failure or the like.

For example, the fixing roller 22 overheats when the image forming apparatus 1 is warmed up, for example, that is, when the fixing device 7 starts while the fixing device 7 is cool. Accordingly, the center portion 22C of the fixing roller 22 in the axial direction thereof overheats. That is, when the fixing device 7 starts while the image forming apparatus 1 is cool and the halogen heater pair 30 heats the fixing roller 22, the halogen heater pair 30 starts heating the fixing roller 22 while the temperature of a periphery of the fixing roller 22 is low. Accordingly, the fixing roller 22 dissipates heat in a substantial amount from both lateral end portions 22L of the fixing roller 22 in the axial direction thereof. Consequently, the temperature of the fixing roller 22 increases more quickly in the center portion 22C of the fixing roller 22 in the axial direction thereof than in the lateral end portion 22L of the fixing roller 22 in the axial direction thereof. While the fixing roller 22 is heated to a fixing temperature at which the toner image is fixed on the sheet P properly, the center portion 22C of the fixing roller 22 in the axial direction thereof may overheat easily.

According to this embodiment, in order to downsize the fixing device 7 and save energy, for example, a width of each of the center heater 30*a* and the lateral end heater 30*b* is not substantially greater than the maximum conveyance span H in the axial direction of the fixing roller 22. An outboard edge of the main heat generator 30*b*1 of the lateral end heater 30*b* in the axial direction of the fixing roller 22 is substantially disposed opposite an outboard edge of the maximum conveyance span H. That is, a width of the main heat generator 30*b*1 is minimized. Accordingly, the halogen heater pair 30 generates a decreased amount of heat toward both lateral end portions 22L of the fixing roller 22 in the axial direction thereof, producing a temperature difference between the center portion 22C and both lateral end portions 22L of the fixing roller 22 in the axial direction thereof easily.

According to this embodiment, the rated power of the center heater 30*a* is greater than the rated power of the lateral end heater 30*b*. Accordingly, the center portion 22C of the fixing roller 22 in the axial direction thereof is susceptible to overheating.

Figure 5:
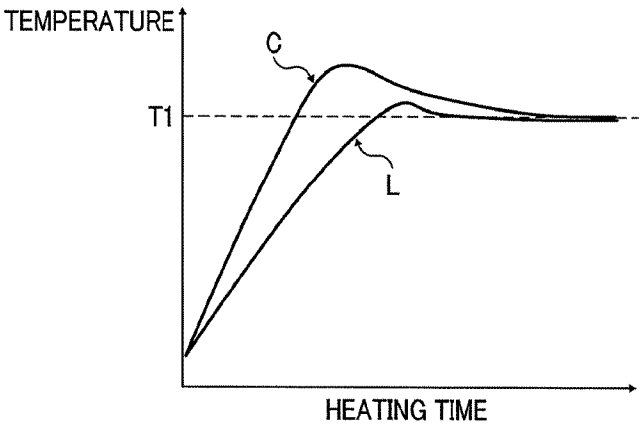
FIG. 5 is a graph illustrating one example of change in the temperature of a fixing roller incorporated in the fixing device depicted in FIG. 3 over time when the image forming apparatus depicted in FIG. 1 is warmed up.

FIG. 5 is a graph illustrating one example of change in the temperature of the fixing roller 22 over time when the image forming apparatus 1 is warmed up. FIG. 5 illustrates change in the temperature of the center portion 22C and the lateral end portion 22L of the fixing roller 22 in the axial direction thereof when the image forming apparatus 1 is powered off overnight and started in the next morning to energize the fixing device 7 so that the halogen heater pair 30 starts heating the fixing roller 22. In FIG. 5, a vertical axis represents the temperature of the fixing roller 22. A horizontal axis represents the heating time for which the halogen heater pair 30 heats the fixing roller 22. A curve C represents the temperature of the center portion 22C of the fixing roller 22 in the axial direction thereof. A curve L represents the temperature of the lateral end portion 22L of the fixing roller 22 in the axial direction thereof.

As illustrated in FIG. 5, since each lateral end portion 22L of the fixing roller 22 dissipates heat as described above, for example, the temperature of the center portion 22C of the fixing roller 22 in the axial direction thereof increases more quickly than each lateral end portion 22L of the fixing roller 22 in the axial direction thereof. Hence, the center portion 22C of the fixing roller 22 in the axial direction thereof overshoots a target temperature T1 of the fixing roller 22 substantially.

The center portion 22C of the fixing roller 22 in the axial direction thereof is more susceptible to temperature increase than each lateral end portion 22L of the fixing roller 22 in the axial direction thereof. Accordingly, the center portion 22C of the fixing roller 22 in the axial direction thereof is susceptible to overheating as described above. To address this circumstance, the temperature of the center portion 22C of the fixing roller 22 in the axial direction thereof is managed precisely.

Also, when rotation of the fixing roller 22 is interrupted accidentally as the sheet P is jammed at the fixing nip N, for example, the fixing roller 22 is susceptible to overheating. That is, when rotation of the fixing roller 22 is interrupted as the sheet P is jammed, for example, the halogen heater pair 30 heats a particular part of the fixing roller 22 intensively, resulting in overheating of the particular part of the fixing roller 22. In this case also, as the center temperature detector 31 detects the temperature of the fixing roller 22 more slowly, the halogen heater pair 30 heats the fixing roller 22 locally for a longer time, resulting in overheating of the fixing roller 22.

To prevent overheating of the center portion 22C of the fixing roller 22 in the axial direction thereof described above, according to this embodiment, a thermal time constant of the center temperature detector 31 with respect to the fixing roller 22 is smaller than a thermal time constant of the lateral end temperature detector 32 with respect to the fixing roller 22, thus enhancing responsiveness of the center temperature detector 31. Accordingly, the center temperature detector 31 detects change in the temperature of the center portion 22C of the fixing roller 22 in the axial direction swiftly.

Even if the fixing device 7 according to this embodiment incorporates the fixing roller 22 that has the reduced thermal capacity and the center portion 22C in the axial direction thereof, which is susceptible to temperature increase, the controller 33 controls the center heater 30*a* to adjust the heat generation amount swiftly in accordance with change in the temperature of the fixing roller 22, thus preventing overheating of the center portion 22C of the fixing roller 22 in the axial direction thereof.

Even if rotation of the fixing roller 22 is interrupted accidentally as the sheet P is jammed, for example, and the halogen heater pair 30 heats a part of the fixing roller 22 intensively, the center temperature detector 31 detects sharp temperature increase of the fixing roller 22 earlier so that the halogen heater pair 30 interrupts heating the fixing roller 22 or decreases the heat generation amount. Accordingly, the controller 33 of the fixing device 7 controls the temperature of the fixing roller 22 to a predetermined temperature or lower, preventing overheating of the fixing roller 22 and therefore preventing degradation of the toner image on the sheet P, fixing failure, and degradation of the fixing roller 22.

For example, according to this embodiment, the thermal time constant of the thermopile used as the center temperature detector 31 is in a range of from about 10 msec to about 30 msec. The thermal time constant of the thermistor used as the lateral end temperature detector 32 is about 1 sec. The thermal time constant described above defines a thermal time constant between the outer circumferential surface of the fixing roller 22 and each of the center temperature detector 31 and the lateral end temperature detector 32 that is disposed opposite the fixing roller 22.

Figure 6:
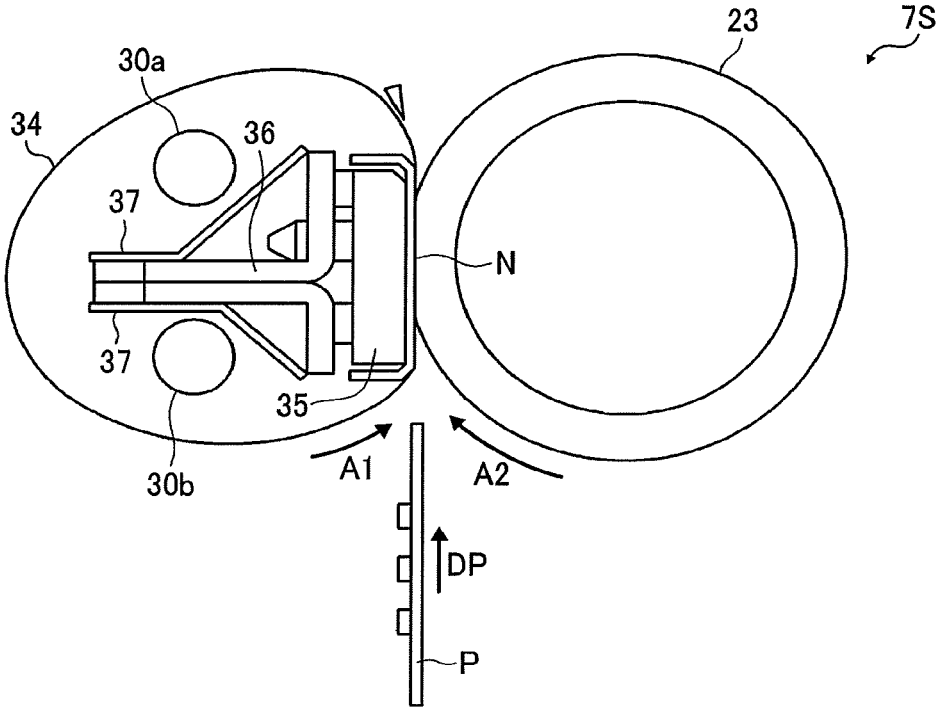
FIG. 6 is a schematic vertical cross-sectional view of a fixing device installable in the image forming apparatus depicted in FIG. 1.

The embodiments described above illustratively describe the construction of the fixing device 7 illustrated in FIG. 2, that employs the fixing roller 22 as a fixing rotator. Alternatively, the embodiments described above are applicable to other fixing devices that do not incorporate the fixing roller 22. For example, the embodiments described above are applicable to a fixing device 7S illustrated in FIG. 6. FIG. 6 is a schematic vertical cross-sectional view of the fixing device 7S.

As illustrated in FIG. 6, the fixing device 7S includes a fixing belt 34, that is, an endless belt serving as a fixing rotator. The pressure roller 23 is pressed against the fixing belt 34 to form the fixing nip N therebetween.

The center heater 30*a* and the lateral end heater 30*b* are disposed opposite an inner circumferential surface of the fixing belt 34. Like the fixing device 7 illustrated in FIG. 2, the fixing device 7S includes a non-contact thermopile as the center temperature detector 31 that detects the temperature of a center portion of the fixing belt 34 in an axial direction thereof without contacting the fixing belt 34. The fixing device 7S further includes a contact thermistor as the lateral end temperature detector 32 that detects the temperature of a lateral end portion of the fixing belt 34 in the axial direction thereof by contacting the fixing belt 34. The thermal time constant of the thermopile is smaller than the thermal time constant of the thermistor.

The fixing device 7S further includes a nip formation pad 35, a stay 36, and a reflector 37 that are disposed opposite the inner circumferential surface of the fixing belt 34.

The nip formation pad 35 is disposed opposite the pressure roller 23 via the fixing belt 34 to form the fixing nip N. The stay 36 is disposed opposite the pressure roller 23 via the nip formation pad 35 and the fixing belt 34. The stay 36 supports the nip formation pad 35 against pressure from the pressure roller 23, preventing the nip formation pad 35 from being bent by the pressure from the pressure roller 23. The reflector 37 is interposed between the stay 36 and each of the center heater 30*a* and the lateral end heater 30*b*. The reflector 37 reflects radiant heat or light radiated from the center heater 30*a* and the lateral end heater 30*b* to the reflector 37 mounted on the stay 36 toward the fixing belt 34.

Since the fixing device 7S according to this embodiment employs the fixing belt 34 having a thermal capacity that is smaller than a thermal capacity of the fixing roller 22 constructed of the base layer 22*b* made of metal and the surface layer 22*a* coating the base layer 22*b* as illustrated in FIG. 2, the fixing device 7S saves energy. However, since the fixing belt 34 is heated readily for a decreased time, if the center temperature detector 31 suffers from delay in response as described above, the fixing belt 34 is susceptible to overheating. To address this circumstance, the center temperature detector 31 and the lateral end temperature detector 32 that detect the temperature of the fixing belt 34 are configured as described above, preventing the fixing belt 34 from overheating due to delay in response of the center temperature detector 31.

The present disclosure is not limited to the details of the embodiments described above and various modifications and improvements are possible.

For example, the image forming apparatus 1 depicted in FIG. 1 is a color printer. Alternatively, the image forming apparatus 1 may be a monochrome printer, a copier, a facsimile machine, a multifunction peripheral, or the like.

The sheets P serving as recording media may be thick paper, postcards, envelopes, plain paper, thin paper, coated paper, art paper, tracing paper, overhead projector (OHP) transparencies, plastic film, prepreg, copper foil, and the like.

A description is provided of advantages of the fixing devices 7 and 7S.

As illustrated in FIGS. 2 and 6, a fixing device (e.g., the fixing devices 7 and 7S) includes a fixing rotator (e.g., the fixing roller 22 and the fixing belt 34), a pressure rotator (e.g., the pressure roller 23), a primary heater (e.g. the center heater 30*a*), a secondary heater (e.g., the lateral end heater 30*b*), a primary temperature detector (e.g., the center temperature detector 31), and a secondary temperature detector (e.g., the lateral end temperature detector 32).

The fixing rotator is rotatable in a rotation direction (e.g., the rotation direction A1). The pressure rotator is rotatable and contacts the fixing rotator to form a fixing nip (e.g., the fixing nip N) therebetween, through which a recording medium (e.g., a sheet P) bearing a toner image is conveyed.

As illustrated in FIG. 3, the primary heater mainly heats a primary portion (e.g., the center portion 22C) of the fixing rotator. The secondary heater mainly heats a secondary portion (e.g., the lateral end portion 22L) of the fixing rotator. The secondary portion is disposed outboard from the primary portion in an axial direction of the fixing rotator. The primary temperature detector detects a temperature of the primary portion of the fixing rotator. The secondary temperature detector detects a temperature of the secondary portion of the fixing rotator. The primary temperature detector is isolated from the fixing rotator and detects the temperature of the fixing rotator without contacting the fixing rotator. The secondary temperature detector contacts the fixing rotator and detects the temperature of the fixing rotator by contacting the fixing rotator. A thermal time constant of the primary temperature detector is smaller than a thermal time constant of the secondary temperature detector.

Since the thermal time constant of the primary temperature detector is smaller than the thermal time constant of the secondary temperature detector, the primary temperature detector responds to change in the temperature of the primary portion of the fixing rotator in the axial direction thereof at an improved speed. Accordingly, even if the primary temperature detector is a non-contact temperature detector, the primary temperature detector enhances responsiveness to temperature increase of the primary portion of the fixing rotator in the axial direction thereof. Hence, the fixing device employs the primary temperature detector and the secondary temperature detector according to characteristics of detection positions where the primary temperature detector and the secondary temperature detector detect the temperature of the fixing rotator, thus preventing overheating of the primary portion of the fixing rotator in the axial direction thereof.

As illustrated in FIG. 3, the fixing device 7 employs a center conveyance system in which the sheet P is centered on the fixing roller 22 in the axial direction thereof. Alternatively, the fixing device 7 may employ a lateral end conveyance system in which the sheet P is conveyed in the sheet conveyance direction DP along one lateral end of the fixing roller 22 in the axial direction thereof. In this case, one of the main heat generators 30*b*1 of the lateral end heater 30*b* and one of the sub heat generators 30*a*2 of the center heater 30*a* are eliminated. Another one of the main heat generators 30*b*1 of the lateral end heater 30*b* and another one of the sub heat generators 30*a*2 of the center heater 30*a* are distal from the one lateral end of the fixing roller 22 in the axial direction thereof.

According to the embodiments described above, each of the fixing roller 22 and the fixing belt 34 serves as a fixing rotator. Alternatively, a fixing film or the like may be used as a fixing rotator. Further, the pressure roller 23 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing rotator including:

a primary portion; and a secondary portion disposed outboard from the primary portion in an axial direction of the fixing rotator;

a pressure rotator contacting the fixing rotator to form a fixing nip between the fixing rotator and the pressure rotator, the fixing nip through which a recording medium is conveyed;

a primary heater to heat the primary portion of the fixing rotator;

a secondary heater to heat the secondary portion of the fixing rotator;

a primary temperature detector, being isolated from the fixing rotator, to detect a temperature of the primary portion of the fixing rotator without contacting the fixing rotator; and a secondary temperature detector, contacting the fixing rotator, to detect a temperature of the secondary portion of the fixing rotator by contacting the fixing rotator, the primary temperature detector having a thermal time constant that is smaller than a thermal time constant of the secondary temperature detector.

2. The fixing device according to claim 1, wherein the primary temperature detector includes a thermopile.

3. The fixing device according to claim 1, wherein the secondary temperature detector includes a thermistor.

4. The fixing device according to claim 1, wherein a rated power of the primary heater is greater than a rated power of the secondary heater.

5. The fixing device according to claim 1, wherein the primary heater and the secondary heater heat the fixing rotator at a speed of 20 degrees centigrade per second or more.

6. The fixing device according to claim 1, wherein the recording medium is a maximum recording medium conveyable over the fixing rotator, and wherein the secondary temperature detector is disposed outboard from a maximum conveyance span of the fixing rotator in the axial direction of the fixing rotator, the maximum conveyance span where the maximum recording medium is conveyed over the fixing rotator.

7. The fixing device according to claim 1, wherein the primary portion of the fixing rotator is a center portion of the fixing rotator in the axial direction of the fixing rotator, and wherein the secondary portion of the fixing rotator is a lateral end portion of the fixing rotator in the axial direction of the fixing rotator.

8. The fixing device according to claim 1, wherein the primary heater includes:

a main heat generator to generate a first amount of heat; and a sub heat generator to generate a second amount of heat that is smaller than the first amount of heat of the main heat generator.

9. The fixing device according to claim 8, wherein the main heat generator of the primary heater is disposed in a center span of the primary heater in the axial direction of the fixing rotator.

10. The fixing device according to claim 1, wherein the secondary heater includes:

a main heat generator to generate a first amount of heat; and a sub heat generator to generate a second amount of heat that is smaller than the first amount of heat of the main heat generator.

11. The fixing device according to claim 10, wherein the main heat generator of the secondary heater is disposed in a lateral end span of the secondary heater in the axial direction of the fixing rotator.

12. The fixing device according to claim 1, wherein the fixing rotator includes a fixing roller.

13. The fixing device according to claim 1, wherein the fixing rotator includes a fixing belt.

14. An image forming apparatus comprising:

an image bearer to bear a toner image; and a fixing device to fix the toner image on a recording medium, the fixing device including:

a fixing rotator including:

a primary portion; and a secondary portion disposed outboard from the primary portion in an axial direction of the fixing rotator;

a pressure rotator contacting the fixing rotator to form a fixing nip between the fixing rotator and the pressure rotator, the fixing nip through which the recording medium is conveyed;

a primary heater to heat the primary portion of the fixing rotator;

a secondary heater to heat the secondary portion of the fixing rotator;

a primary temperature detector, being isolated from the fixing rotator, to detect a temperature of the primary portion of the fixing rotator without contacting the fixing rotator; and a secondary temperature detector, contacting the fixing rotator, to detect a temperature of the secondary portion of the fixing rotator by contacting the fixing rotator, the primary temperature detector having a thermal time constant that is smaller than a thermal time constant of the secondary temperature detector.

* * * * *